United States Patent [19]

Hunter

[11] Patent Number: 4,995,631

[45] Date of Patent: Feb. 26, 1991

[54] MONO-SKI DEEP SIDE CUTS FOR USER STABILITY CONTROL

[76] Inventor: Kent Hunter, 3017 E. 9400 S., Sandy, Utah 84092

[21] Appl. No.: 522,478

[22] Filed: May 11, 1990

Related U.S. Application Data

[63] Continuation of Ser. No. 278,560, Dec. 1, 1990, abandoned.

[51] Int. Cl.[5] ..... A63C 5/03

[52] U.S. Cl. ..... 280/607; 280/609; 280/14.2; D21/229

[58] Field of Search ..... 280/600, 601, 602, 607, 280/609, 610, 14.1, 14.2; 441/68, 71, 74; D12/8; D21/229

[56] References Cited

U.S. PATENT DOCUMENTS

| | | | |
|---|---|---|---|
| 3,154,312 | 10/1964 | Marchand | 280/14.2 X |
| 3,724,866 | 4/1973 | Kaplan | 280/607 |
| 3,758,127 | 9/1973 | Doyle et al. | 280/607 |
| 3,782,745 | 1/1974 | Stoveken | 280/18 |
| 3,900,204 | 8/1975 | Weber | 280/607 |
| 3,933,360 | 1/1976 | Arai | 280/601 |
| 3,947,049 | 3/1976 | Pedersen | 280/607 X |
| 4,071,264 | 1/1978 | Legrand et al. | 280/610 |
| 4,305,603 | 12/1981 | Müller et al. | 280/607 |
| 4,405,139 | 9/1983 | Kawahard | 441/74 X |
| 4,533,150 | 8/1985 | Hardy | 280/609 X |
| 4,679,814 | 7/1987 | Meatto et al. | 280/610 |
| 4,756,544 | 7/1988 | Abondance | 280/609 |

FOREIGN PATENT DOCUMENTS

| | | | |
|---|---|---|---|
| 2924023 | 12/1980 | Fed. Rep. of Germany | 280/14.2 |
| 2446654 | 9/1980 | France | 280/601 |
| 2581322 | 11/1986 | France | 280/14.2 |
| 274723 | 7/1951 | Switzerland | 280/609 |
| 0569492 | 11/1975 | Switzerland | 280/28.14 |
| 8002232 | 10/1980 | World Int. Prop. O. | 280/601 |

OTHER PUBLICATIONS

"Swingbo", Bouvarel Reunis, Grenoble, 76.46.87.85 (Catalog advertisement) no publication date.

*Primary Examiner*—Charles A. Marmor
*Assistant Examiner*—Brian L. Johnson
*Attorney, Agent, or Firm*—Terry M. Crellin

[57] ABSTRACT

A mono-ski for alpine skiiing to which both of the skier's boot bindings are mounted such that the skier's boots are side by side, close together and both facing forward. The widest part of the forward or shovel area of the mono-ski is thirty percent or more wider than the narrowest part of the central or waist area of the mono-ski. The mono-ski has concave side-cuts which are three-quarters of an inch or more. The forward or shovel area of the mono-ski slopes gradually upward over at least the forward fifteen percent and the rear or tail area slopes gradually upward over at least the rear seven percent of the total length of the mono-ski. The skier's boots are positioned rearward of the center, the thickness of the mono-ski is greatest at the central or waist area, the bottom is flat transversely without grooves and the mono-ski has camber. The bottom running surface should be of polyethylene or similar material. It is desirable that the top surface also be of the same material, to have bottom metal edges, interior reinforcing plates under the boot bindings and a protective metal insert in the tail of the mono-ski. The mono-ski can be made by methods and of materials commonly used in the industry.

2 Claims, 1 Drawing Sheet

MONO-SKI DEEP SIDE CUTS FOR USER STABILITY CONTROL

This application is a continuation of application Ser. No. 07/278,560 filed Dec. 1, 1990 and now abandoned.

BACKGROUND OF THE INVENTION

Skiing first evolved as a means of moving about efficiently in the deep snow of the Scandanavian countries. Two skis (dual skis) were necessary as the skis were used to allow a walking motion in snow. After the turn of the century the idea of sliding downhill and being mechanically pulled up again as a recreational sport occurred to many people. For well over 100 years people had been moving about on dual skis so it was only natural that dual skis would be used to slide downhill for recreation. The technology of dual skis performance soon became specialized for downhill (alpine) skiing. In the last 30 years modern technology has been applied to the boots and bindings as well as the dual skis themselves to where today boots, bindings and dual skis perform with magnificent ease compared to the equipment of even 20 years ago.

Inventors like Jacques Marchand, May 11, 1961, U.S. Pat. No. 3,154,312, Micheal D. Doyle, Sept. 11, 1973, U.S. Pat. No. 3,758,127, Alec Pedersen, Mar. 30, 1976, U.S. Pat. No. 3,947,049 realized the advantages of a mono-ski for alpine skiing and explained many of the advantages in each of their inventions. But dual skis were well established with dual ski technology improving every year. The inventors mentioned were all heading in the right direction but none of their mono-skis were so far superior as to make a major impact on dual ski popularity. The subject invention mono-ski has the level of superiority over not only dual but all existing art mono-skis to finally bring to the skiing public the greatly increased thrill and exhilaration of skiing that a properly designed mono-ski makes possible.

To properly cover the subject, snow-boards should be mentioned. Firstly, the mono-ski of Robert C. Weber, Aug. 19, 1975, U.S. Pat. No. 3,900,204 is today considered a snow-board. As in the invention of Robert C. Weber, above, Wayne E. Stoveken, Jan. 1, 1974, U.S. Pat. No. 3,782,745, Marcel and Urs Muller, Dec. 15, 1981, U.S. Pat. No. 4,305,603, and Kuniski Kawahard, Sept. 20, 1983, U.S. Pat. No. 4,405,139, snow-boards are utilized with the skier standing sideways on the board and using a technique similar to surfing and skate-boarding. This is a great advantage as children can inexpensively learn the technique on skate-boards and then later easily adapt to the far more expansive and exhilarating but more costly sport of snow-boarding. Snow-boarding is an entirely different type of alpine skiing than mono-skiing and will soon attract its own substantial share of the alpine skiing market.

There are professionals and leaders in the industry who believe it is only a matter of time before most alpine skiing will be done on mono-skis and snow-boards.

OBJECT OF THE INVENTION

The object of this invention was to create a ski which would make it possible for all skiers, regardless of age or skill level, to quickly or immediately enjoy the thrill and exhilaration of alpine skiing that comes when the skier is able to easily execute smooth effortless controlled turns as tight as the skier desires on any slope and regardless of how difficult the snow conditions. The subject invention mono-ski has the capabilities necessary to accomplish this end.

Turning a dual ski properly requires five coordinated movements, strong rotational body force transferred through the legs to the ski, putting the ski on edge, transferring weight from the downhill to the uphill ski, keeping the two skis parallel and close together and unweighting the tail of the ski. All five motions must be perfectly coordinated if tight controlled turns are to be accomplished in any snow conditions. It is so difficult to perfectly coordinate all five of these motions that few skiers ever reach the expert level and therefore never fully enjoy alpine skiing.

The subject invention mono-ski totally eliminates the necessity for unweighting, and as does any mono-ski, eliminates the necessity of shifting weight from one ski to the other and the necessity of keeping both skis parallel and close together. The subject invention mono-ski therefore eliminates the necessity for three of the five motions needed to properly turn dual skis. Only the two remaining motions need be used to properly turn the subject invention mono-ski and on groomed slopes only one of the two motions need be used by a beginning skier. This motion is the setting of the edge of the mono-ski. This means that the beginning skier can comfortably come down a groomed slope having to concentrate on only one motion, rocking the subject invention mono-ski from one edge to the other. This can easily be mastered in a matter of hours. Next the beginning skier can concentrate on the only other motion needed, keeping the body always facing downhill. The rotational forces automatically generated by keeping the body always facing downhill are sufficient, combined with setting the mono-ski's edges, to enable the skier to execute smooth effortless controlled turns as tight as the skier desires on any slope regardless of how difficult the snow conditions.

In summary, the subject invention mono-ski is considerably easier to ski than dual skis or existing art mono-skis. Any dual skier or existing art mono-skier, regardless of their skill level, can switch over to the subject invention mono-ski and immediately ski better than they did before and any beginning skier will become a better skier much sooner.

Many skiers think it will be difficult to switch over to a mono-ski as all the skier's weight should be on the uphill boot, not the downhill boot as is required when skiing dual skis. It is unnatural to put weight on the downhill boot so this must be learned by a great deal of practice when skiing dual skis. It is completely natural to put weight on the uphill boot so this does not need to be learned when skiing a mono-ski. Interestingly, even expert skiers who have trained their body to put their weight on the downhill ski will automatically correctly put their weight on the uphill boot on the very first turn when switching over to a mono-ski. The beginning skier will also, automatically and without thinking, correctly put their weight on the uphill boot including shifting their weight to the uphill boot during a turn.

Balance when standing still is not a problem for even the beginner as the unusually wide forward section of the subject invention mono-ski gives ample sideways platform balance support. Ski pole use is exactly the same for the mono-ski as for dual skis.

It is important to note that alpine skiing is a sport which few people beyond forty and hardly any beyond sixty engage in and enjoy. It is the difficulty and effort required to ski dual and existing art mono-skis at an enjoyable and safe skill level that prevents most middle aged and senior skiers from staying with the sport or taking up the sport. The subject invention mono-ski will open up to this group and to all skiers and would be skiers the thrill and exhilaration of alpine skiing that comes when the skier is able to easily execute smooth effortless controlled turns as tight as the skier desires on any slope and regardless of how difficult the snow conditions.

SUMMARY

A mono-ski for alpine skiing where the skier's boots are side by side, close together and facing forward and which has an entirely new overall special shape and contour. Different lengths may be made but the relationship of certain dimensions to each other must remain the same as the preferred embodiment.

The mono-ski has an unusually wide forward or shovel area which is at least thirty percent or more wider than the narrowest part of the central or waist area. This creates the unusually severe side-cut which allows the mono-ski to be easily turned and without unweighting. It also allows the mono-ski to float easily above or below the surface in light powder snow and to float easily on top of melting snow. Further, it allows the mono-ski to float through deep tracked "crud" conditions and ride over tracked melting snow which has refrozen without being directionally destabilized. Still further, it provides sideways platform stability when the skier is not moving.

The rear or tail area of the mono-ski is considerably narrower than the forward or shovel area. This combined with the boots being mounted towards the rear or tail area results in the rear or tail area supporting at least twice the weight per square inch as the forward or shovel area. This gives the mono-ski the capability of running straight when the skier wants to go straight, something hard to do on existing art mono-skis.

The forward and rear areas of the mono-ski slope gently upward allowing depth control in deep powder, lowering tail resistance in skidding turns and shortening the forward and rear snow contact points which furthers the capability of the mono-ski to turn easily and without unweighting.

It is recommended that the mono-ski be of stiffer than normal construction and have greater than normal camber. This increases the bite into the snow of the severe concave side-cut when the mono-ski is put on edge increasing the mono-ski's turning force. It also puts more weight on the rear area relative to the forward area, increasing the mono-ski's capability to run straight when the skier wants to go straight.

It is further recommended that a foam core be used, aluminum plates be laminated in the mono-ski to securely hold boot binding screws, the bottom be flat transversely without grooves and a protective metal insert be laminated into the tail of the mono-ski. The same non-stick material, such as polyethylene, should be used on the top surface as on the bottom to prevent snow build-up on the mono-ski.

The mono-ski can be made by methods and of materials as are commonly used in the ski industry.

DETAILED DESCRIPTION

The subject invention is most like a mono-ski and is therefore called a mono-ski throughout the Specification. The subject invention mono-ski is for alpine skiing and has both of the skier's boot bindings mounted so that the skier's boots are side by side, close together and both facing forward. The subject invention mono-ski has an entirely new overall special shape and contour.

Figure 1:
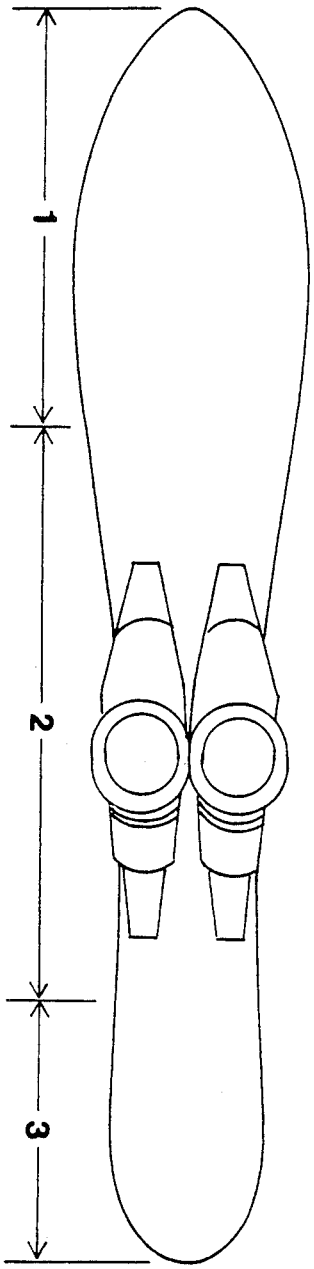
FIG. 1 is a top plan view of the preferred embodiment of the mono-ski and mounted boots.
Figure 2:
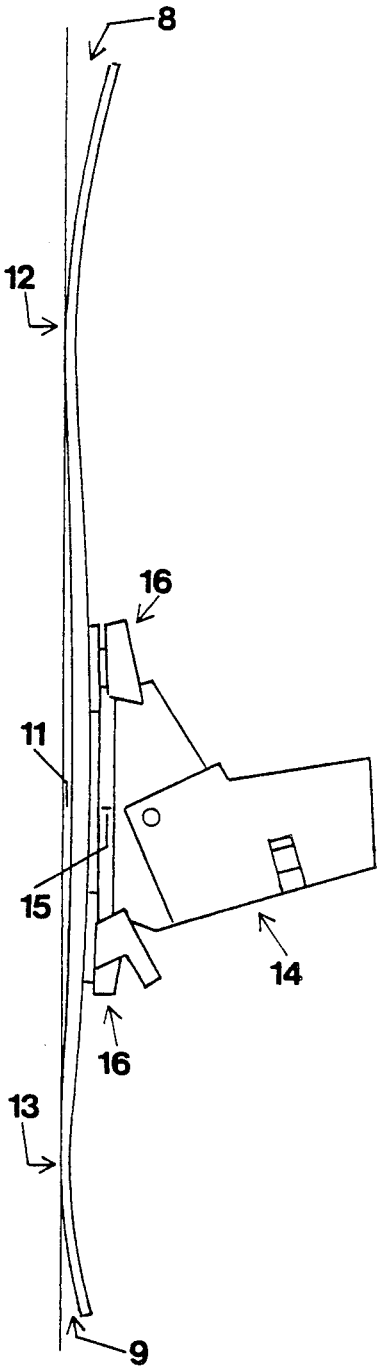
FIG. 2 is a side elevation veiw of the preferred embodiment of the mono-ski and mounted boots.
Figure 3:
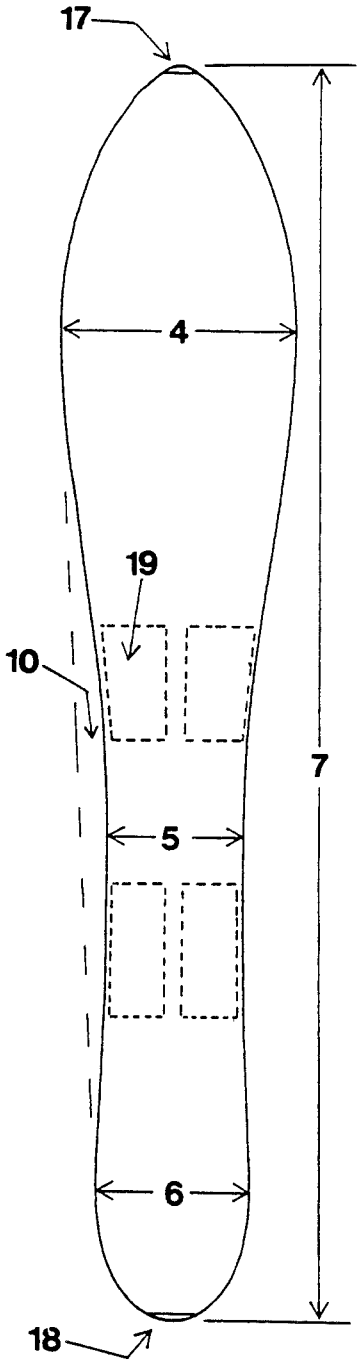
FIG. 3 is a top plan view of the preferred embodiment mono-ski.

Referring to FIGS. 1 through 3, in the preferred embodiment of the subject invention mono-ski, the forward or shovel area (1) is $12\frac{1}{4}$ inches wide (4), the central or waist area (2) is $7\frac{1}{8}$ inches wide (5), the rear or tail area (3) is 8 inches wide (6), the straight line length is $64\frac{3}{4}$ inches (7), the side-cut (10) is $1\frac{3}{8}$ inches and the camber (11) is $\frac{1}{2}$ inch. Of the extensive prototypes tested it is this embodiment that is preferred. Different lengths may be made but the relationship of certain dimensions to each other must remain the same as those of the preferred embodiment if the performance characteristics of the preferred embodiment are to be maintained.

For a longer or shorter subject invention mono-ski the proper relationship between these certain dimensions will be maintained by using the following formula. The decimal relationship of the new desired length is first established by dividing the straight line length of the new desired length mono-ski by the straight line length of the preferred embodiment (7). This decimal relationship is then multiplied times the widest forward (4), narrowest central (5) and widest rear areas (6) of the preferred embodiment. Said obtained "decimal relationship determined dimensions" are held and modified as follows.

The width of the narrowest or central area of the new desired length mono-ski is dependent upon the width of the two ski boots that will be mounted side by side towards the rear of the central area. If the new desired length is being made for young children then the width can be as little as 6 inches. If the new desired length is expected to be used by male adults the width should be as much as $7\frac{1}{8}$ inches.

Next the narrowest central area "decimal relationship determined dimension" width of the new desired length mono-ski is subtracted from the narrowest central area width of the new desired length mono-ski as is determined by the expected width of the two side by side ski boots. If the result is a minus figure then this amount is subtracted from the "decimal relationship determined dimensions" for the widest forward area and the widest rear area of the new desired length mono-ski. If the result is a plus figure then this amount is added to the "decimal relationship determined dimensions" for the widest forward area and the widest rear area of the new desired length mono-ski. The camber of the new desired length mono-ski is determined by multiplying the decimal relationship times the camber of the preferred embodiment (11). The distance from the tip to the mid-sole mark on the mounted boot of the new desired length mono-ski is also determined by multiplying the decimal relationship times the distance from the tip (17) to the mid-sole mark on the mounted boot (15) of the preferred embodiment.

The unusually severe concave side-cut (10) of the subject invention mono-ski is critical in the capability of the mono-ski to be turned by the skier with extreme ease and with no unweighting. The unusually severe concave side-cut (10) is a result of the unusually wide forward or shovel area (1) and narrow as possible central or waist area (2). As noted in FIG. 3, the side-cut (10) is the maximum distance from the side of the mono-ski at the central or waist area (2) out to a point which intersects a straight line drawn from the widest part of the forward or shovel area (1) of the mono-ski to the widest part of the rear or tail area (3) of the mono-ski.

Modern skiing techniques require that the ski be tilted back and forth, from one edge to the other, in making continuous linked turns. The further out the edges of the widest forward and rear areas of the ski are from the centerline of the boots the more effort is required to tilt the ski on edge. The edges are out considerably further on the preferred embodiment of the subject invention mono-ski than any existing art mono-ski or dual ski, however it is still not tiring or difficult to tilt the subject invention mono-ski continuously back and forth from one edge to the other. The reason is that modern plastic ski boots immobilize the ankle and then reach at least to the calf making the entire length of the leg a long and powerful lever arm rigidly attached to the ski. However, even with modern ski boots, edges further out than the preferred embodiment will become tiring to continuously tilt on edge.

The importance of eliminating unweighting when making turns is noted throughout the Specification as one of the desirable objects of this invention. It is principally the unusually severe concave side-cut (10) that makes this possible. The advantage of totally eliminating the necessity of unweighting when making a turn, even in the most resistive snow conditions such as sticky wet snow or windblown crust, is that the skier is freed from a considerable amount of physical effort. Most skiers will experience a less difficult and more fluid motion. All skiers will be physically able to make more turns and ski more terrain in a given period.

The necessity for unweighting when skiing existing art skis needs to be explained as even in the industry not everyone understands the mechanics of turning a ski. Briefly, skiing conventional design dual or mono-skis, the skier must apply sufficient rotational force with his body to skid the tail of the ski sideways through a turn. Contrary to popular belief, conventional skis do not totally carve their turn in anything less than a giant slalom turn. Most of the time conventional design dual or mono-skis are too long or snow conditions too resistive to allow skidding the tail of the ski sideways through the desired turn without unweighting the tail of the ski. This means the skier must unweight the tail of the ski at the same instant he is applying rotational force to the ski. This unweighting sufficiently frees the tail area of the ski from the resistance of the snow so that it can respond to the rotational forces applied by the skier and skid sideways through the desired turn. The unweighting is accomplished by either a hopping motion or a fast sinking motion. As this must be done on every turn it can be seen a great deal of energy is consumed.

The subject invention mono-ski can carve a tighter turn than any existing art dual or mono-ski, however when it rotates inside its own length or makes a very tight turn, even it can do so only with a considerable amount of sideways skidding. However, the subject invention's unusually severe concave side-cut (10) and rounded (18) upward sloping (9) rear or tail area (3), which will be explained further on, make it possible to execute such turns without unweighting, saving, as noted, a great deal of energy.

The unusually wide forward or shovel area (1) of the mono-ski serves a number of purposes. First, it creates the unusually severe concave side-cut (10). Secondly, the unusually wide forward or shovel area (1) of the mono-ski allows the mono-ski to float easily above or below the surface in light powder snow. When skiing on melting snow, unless the ski can float on top, as does the subject invention mono-ski, such melting snow can make turning conventional dual or mono-skis which sink in, extremely difficult. The unusually wide forward or shovel area (1) also makes it possible for the subject invention mono-ski to float through and turn in deep tracked "crud" conditions without being directionally destabilized. Using conventional dual or mono-skis, skiing in such "crud" is difficult for all but expert skiers. Melting snow which is skied and then refreezes overnight, has ruts, tracks and clumps of frozen snow which catch and misdirect narrow skis. Again, the unusually wide forward or shovel area (1) of the subject invention mono-ski is wide enough so that it is not directionally destabilized by these conditions and therefore can be easily turned in these conditions and without unweighting. A further advantage of the unusually wide forward or shovel area is that it provides sideways platform stability when the skier is not moving. The skier always has ski poles but it is safer and a more comfortable feeling for most skiers if they can easily balance themselves when not moving without having to use their ski poles.

The central or waist area (2) of the mono-ski is where the boots (14) are mounted. The boots (14) are positioned side by side, close together and both facing forward. In the preferred embodiment the mid-sole mark (15) on the mounted ski boot (14) should be 39¼ inches back on a straight line from the forward tip of the mono-ski (17). This is 60.6% of the straight line length of the mono-ski back from the forward tip (17).

The rear or tail area of the mono-ski (3) is considerably narrower than the forward or shovel area (1). As is explained further on, this helps to keep the mono-ski running straight when the skier wants to go straight. Typically, existing art mono-skis turn easily but are difficult to ski straight. The subject invention mono-ski is considerably easier to turn than any existing art mono-ski even without unweighting and yet is easier to keep straight than any existing art mono-ski. This is accomplished by the rear or tail area (3) being considerably narrower than the forward or shovel area (1) and in addition, the rear or tail area (3) supporting more of the weight of the skier. As noted, the preferred embodiment attaches the boots (14) towards the rear or tail area (3) of the mono-ski which results in the per square inch pressure on the snow being more than double in the rear or tail area (3) than the forward or shovel area (1). This directionally stabilizes the mono-ski when the skier wishes to go straight without reducing the unusual capability of the mono-ski to be turned with extreme ease and without unweighting. To understand this one only has to think of a boat which is heavy in the bow. Such a boat is directionally very unstable whereas the same boat becomes directionally stable if more weight is in the stern than in the bow. While snow is not as fluid a medium as water, it is sufficiently fluid to where the principle still applies.

In the preferred embodiment the forward or shovel area (1) of the mono-ski slopes upward on a gentle curve (8) over 14 inches until it has raised 2¼ inches above the flat snow surface. This gentle forward upward curve (8) is important and differs from prior art mono-skis where boots are positioned side by side, close together and facing forward. Such prior art has a pronounced upward curve near the forward tip of the ski. By having a gentle upward curve (8) the entire mono-ski can be kept below the surface of the snow when skiing deep light powder, a technique preferred by many expert deep powder skiers. If a skier inadvertently runs into a mogul, a sharply curved tip or shovel will usually be abruptly stopped by the mogul, throwing the skier forward. The mono-ski's gentle upward curve (8) will often cut through the mogul depending upon snow conditions and the mogul's size. The mono-ski's gentle upward curve (8) is sufficiently curved to prevent the mono-ski from diving into the snow, even with extreme forward pressure by the skier. Further, the long gentle upward curve (8) at the forward or shovel area (1) of the mono-ski and the relatively long gentle curve (9) at the rear or tail area (3) of the mono-ski, means a much shorter snow contact length than the overall length of the mono-ski. Conventional dual and mono-skis make snow contact 6 to 7 inches back from the tip and 1 to 1½ inches forward of the tail. In the preferred embodiment the mono-ski makes snow contact, (12) and (13), 14 inches back from the tip and 8 inches forward of the tail. The shorter the wheelbase of any vehicle the tighter turn it can make. In the same way a ski also can make shorter turns the closer together the forward and rear snow contact points, (12) and (13), become.

In the preferred embodiment the rear or tail area (3) of the mono-ski slopes upward on a gentle curve (9) over 8 inches until it has raised 1¼ inches above the flat snow surface. The tail is also rounded (18). As has been explained, as with all skis in tight turns, the tail of the ski skids through the turn sideways. As the rear 8 inches (3) of the mono-ski is above the flat snow surface (9) when the tail skids sideways through the turn, resistance to such sideways skidding is greatly reduced. While not as important as the unusually severe concave side-cut (10), this lowered resistance is still important in the capability of the mono-ski to be turned by the skier with extreme ease and without unweighting. The rounded tail (18) also offers less resistance to any snow which it might have to ski through sideways, this being particularly true when the mono-ski is totally below the snow surface as in the generally preferred technique for deep light powder skiing.

Increasing the stiffness and camber of conventional design skis generally decreases their ability to turn and increases their ability to track or ski straight. Therefore dual skis made for high speed downhill racing are made as stiff and with as much camber as good overall design permits. Increasing the stiffness and camber of the subject invention mono-ski does not decrease its ability to turn with extreme ease and without unweighting but rather slightly increases this ability. The reason is that turning with extreme ease and without unweighting is largely made possible by the unusually severe concave side-cut (10). When the subject invention mono-ski is put on edge by the skier, the stiffer the mono-ski and the more camber (10) it has the more the forward part of the concave side-cut arc digs into the snow transmitting an increasingly powerful turning force to the mono-ski itself. Increased stiffness and camber also increases the ability of the mono-ski to track or ski straight. As has been explained, this is a result of the per square inch pressure on the snow being more than double in the rear or tail area (3) than in the forward or shovel area (1). The stiffer the mono-ski and the more camber it has the more of the weight of the skier is placed on the rear area of the mono-ski which increases the rear area's bite into the snow and therefore improves tracking or skiing straight. The camber of the preferred embodiment is ½ inch (11). This is somewhat more than the camber generally found in conventional ski design.

The stiffness of the mono-ski is accomplished by doubling the top structural layer of the mono-ski which conventionally is a single layer of epoxy resin reinforced with woven glass cloth. The skier's weight places a compression force on the top of the mono-ski and a tension force on the bottom of the mono-ski, particularly as the camber is increased. Because compression structural members must be stronger than tension structural members to resist the same force, only the top structural layer needs to be doubled if stiffness is to be increased. This increased stiffness also increases the strength of the mono-ski. This is important to protect the structural integrity of the subject invention mono-ski. The wide forward or shovel area (1) of the mono-ski imparts more than the normal amount of stress found in conventional ski design on the narrowest part of the central or waist area (2), particularly when the skier impacts a mogul. Since the extreme ease of turning and without unweighting, tracking or skiing straight and serviceable life of the mono-ski are all improved by increased strength and resulting stiffness, this then is the recommended construction.

Expanding on the above construction, it should be noted that the subject invention mono-ski, like all conventional ski design for all types of skis, has the thickest part of the ski in the central or waist area (2) tapering out and becoming thinner towards the tip (17) and tail (18) of the mono-ski. This is normal design for structural beam members having to support load in the mid area, such as a ski. This variation in thickness is accomplished by a non-structural spacing material (called a core) in the center layer of the ski's typically laminated construction. This spacing material, which is thicker in the central or waist area, in present art, is often of a plastic foam material. Some manufacturers use a wood core feeling it improves the ski's flex patterns. As the subject invention mono-ski is recommended to be of a very stiff construction, any improved flex patterns from a wood core would be unnoticeable. A foam core is recommended as it will not rot from the inevitable introduction of moisture through binding attachment screw holes and will therefore improve the serviceable life of the mono-ski.

Thin high tensile strength aluminum or other lightweight material plates (19) should be laminated under the top epoxy resin double woven glass reinforced structural layer to securely hold the screws which attach the boot bindings (16) to the mono-ski. Manufacturers often use such plates but many such manufactureres will choose not to use such plates because of cost and or not wanting to increase the stiffness of the ski and interfere with its flex patterns. Once again, as the subject invention mono-ski is recommended to be of a very stiff construction, such plates may be used without detrimentally effecting the performance of the mono-ski. Such plates to securely hold the binding's attachment screws are recommended, and again to increase the serviceable life of the mono-ski.

The bottom running surface of the subject invention mono-ski, in the preferred embodiment, should be flat transversely over the entire length of the mono-ski. A longitudinal groove or grooves will add no noticeable change in the performance characteristics of the mono-ski and is therefore not recommended. Such grooves add cost to production and the material used on the bottom running surface, being thinner in the groove, is more easily torn all the way through in the groove area from the almost unavoidable occasional rock. The bottom running surface should be of polyethylene or any similar non-stick material (known in the industry as P-Tex). The thickness of the P-Tex should be such that it is flush to or slightly above the metal bottom edges. Metal edges that protrude below the bottom running surface (called railing) detrimentally effect the performance of any ski. Thicker P-Tex that is slightly above the metal bottom edges will extend the serviceable life of the mono-ski, particularly if hand file sharpening of the edges is done as opposed to sanding down the entire bottom merely to sharpen the edges.

The top surface of the preferred embodiment of the subject invention mono-ski should be of the same P-Tex or similar material as the bottom running surface. The unusually wide forward or shovel area (1) of the mono-ski tends to mound up with collected snow. The snow will more easily slide off if the top surface of the mono-ski is P-Tex or a similar slippery material. Additional spraying of silicone will prevent even the stickiest snow from building up. Graphics are printed on the underside of the almost transparent P-Tex or similar material top surface as is common in the industry for the bottom P-Tex or similar material running surface.

The tail (18) of the mono-ski should have an aluminum or other lightweight material protective tip molded into the laminated layers of the mono-ski when it is fabricated. The mono-ski is relatively heavy and when set upright on its tail by the skier, as is often necessary, the normal construction material of epoxy resin reinforced by woven glass cloth will soon become damaged and unsightly. A similar protective tip can be molded into the forward tip of the mono-ski for a more finished appearance but is not as necessary as few skiers will set the mono-ski upright on its tip.

The bottom edges of the mono-ski should have protective metal edges. In the preferred embodiment these edges should not be cracked but rather solid. Solid edges are stiffer, but as has been explained, added stiffness is a benefit for the subject invention mono-ski. Also solid edges are stronger, extending the serviceable life of the mono-ski. The bottom metal edges in the preferred embodiment run the entire length of the mono-ski from the forward tip protective insert to the rear tail protective insert which gives the mono-ski a more finished appearance.

Havig described my invention, I now claim:

1. A mono-ski having an elongate body to which a skier's boot bindings are intended to be mounted such that a skier's boots are symmetrically mounted along each side of the longitudinal axis of the ski and pointing in the longitudinal direction, comprising a shovel section separated from a tail section by a waist section, each of said sections having a uniform cross-sectional thickness and a symmetrically orientation along a longitudinal axis which extends along the center of the elongate body, the cross-sectional thickness of said waist section being thicker than the cross-sectional thickness of said shovel and tail sections, said shovel section, waist section and tail section forming a continuous bottom surface of said ski, said shovel section having a widest portion, measured perpendicularly from said longitudinal axis, which is at least 30 percent wider than a narrowest portion of said waist section and approximately 50 percent wider than the widest portion of said tail section similarly measured perpendicularly from said longitudinal axis, said shovel section also having a front end portion, said front end portion being curved upward in a uniform arching shape which extends away from a plane defined by said bottom surface, said tail section also having a widest portion measured perpendicularly from said longitudinal axis, which is wider than said narrowest portion of said waist section, and narrower than said widest portion of said shovel section, said tail section also having an end portion, said tail section end portion being curved upward in a uniform arching shape which extends away from the plane defined by said bottom surface, said widest portion of said tail section being spaced away from, so as to be excluded from said end portion of said tail section, and said end portion of said tail section forming an edge which constitutes a perimeter of said tail section end portion, said perimeter edge being semicircular in shape, whereby when the mono-ski is in contact with a relatively flat sloping surface including covered with snow, rotation of the ski along the ski's longitudinal axis causes shovel and tail contact areas of the ski which contact said flat sloping surface to be concentrated in the shovel section and the tail section in the widest portions thereof and away from the end portion of said shovel section, away from the end portion of said tail section and away from the waist section, said tail section having a smaller contact area than said shovel section, whereby downward force on the tail section of the ski causes greater pressure on the snow at the tail section contact area than a similar force applied to said shovel section.

2. A mono-ski according to claim 1 having side cuts which measure at least $\frac{3}{4}$ of an inch, said side cut measurements being defined as a minimum distance from the narrowest portion of said waist section to a point which intersects a straight line drawn from said widest portion of said shovel section to said widest portion of said tail section.

* * * * *